US005954321A

United States Patent [19]

Spero

[11] Patent Number: 5,954,321

[45] Date of Patent: Sep. 21, 1999

[54] ROTATING JEWELRY CLAMP

[76] Inventor: Vincent A. Spero, 1308 Covington, Blue Springs, Mo. 64015

[21] Appl. No.: 08/996,130

[22] Filed: Dec. 22, 1997

[51] Int. Cl.[6] ..... B25B 1/00

[52] U.S. Cl. ..... 269/254 CS; 81/6; 269/54.4

[58] Field of Search ..... 269/254 CS, 246, 269/47, 48.4, 54.5, 3; 81/7, 6; 29/278

[56] References Cited

U.S. PATENT DOCUMENTS

| | | | |
|---|---|---|---|
| 679,257 | 7/1901 | Ford . | |
| 941,831 | 11/1909 | Widmann | 81/7 |
| 1,428,868 | 9/1922 | Uerkert | 81/6 |
| 1,665,819 | 4/1928 | Plummer . | |
| 2,538,693 | 1/1951 | Maisch | 29/278 |
| 2,618,967 | 11/1952 | Kennedy | 81/6 |
| 2,865,240 | 12/1958 | Kniser | 269/6 |
| 3,022,067 | 2/1962 | Stolz | 81/6 |
| 3,055,329 | 9/1962 | Door . | |
| 3,112,104 | 11/1963 | Jerore . | |
| 3,326,254 | 6/1967 | Diehl . | |
| 3,588,078 | 6/1971 | Van De Sande . | |
| 4,171,800 | 10/1979 | Weaver . | |
| 4,744,552 | 5/1988 | Glaser . | |
| 5,048,805 | 9/1991 | Wiseman | 269/48.4 |

*Primary Examiner*—David A. Scherbel
*Assistant Examiner*—Lee Wilson
*Attorney, Agent, or Firm*—Litman, Kraai and Brown, L.L.C.

[57] ABSTRACT

A rotating jewelry clamp includes a base and a rotatable housing supported thereby such that the housing can be freely rotated relative to the base. The housing threadably receives a clamp assembly with a hollow outer sleeve and a reciprocable piston extending therein. The outer sleeve terminates in an overhanging stationary jaw and the piston includes a movable jaw which mates with the stationary jaw to form a clamp. A lower portion of the piston engages a coil spring within the rotatable housing to urge the piston upward toward the stationary jaw so that jewelry pieces are clamped into position between the movable jaw and the stationary jaw via tension caused by spring action. Insertion and removal of jewelry pieces is accomplished by grasping an insulated handle protruding from the piston and urging the piston downward within the outer sleeve against the spring action, thus separating the movable jaw and stationary jaw.

20 Claims, 2 Drawing Sheets

ROTATING JEWELRY CLAMP

FIELD OF THE INVENTION

The present invention relates to a rotating jewelry clamp, and, more particularly, to such a clamp which quickly and securely clamps a ring, bracelet, chain, pendant, or other piece of jewelry in a position where it is convenient for a jeweler to work on it, particularly for soldering. Once the piece of jewelry is secured, the base of the clamp can be freely rotated so that all sides of the piece of jewelry are easily accessible to a jeweler.

BACKGROUND OF THE INVENTION

Custom jewelry making and jewelry repair work requires exacting and meticulous attention to detail, particularly during soldering operations. Jewelers must have both hands free to handle a torch and shaping tools, etc., and, therefore, need a versatile and reliable holder for the jewelry item on which they are working. Prior art jewelry holders take a variety of forms, including spring loaded tweezers, adjustable vises, set screw operated retainers, etc. Often these holders are held in position by adjustable tension ball joints. Examples of some of these types of prior art jewelry work holders are found in U.S. Pat. Nos. 679,257 to Ford, entitled VISE; 3,055,329 to Door, entitled FINGER RING HOLDER; 3,112,104 to Jerore, entitled UNIVERSALLY ADJUSTABLE WORK HOLDER; 4,171,800 to Weaver, entitled BENCH MOUNTED SUPPORT FOR JEWELRY ARTICLES AND THE LIKE; and 4,744,552 to Glaser, entitled CRAFTSMAN'S JEWELRY SUPPORT TOOL.

Jewelry soldering operations generate intense and concentrated heat, some of which is transferred to the holder. This concentrated heat causes expansion of the metal parts of the holder, which then contract as they cool. This causes set screws and ball joints to loosen, and the expansion and contraction of tweezer-type holders can actually cause the jewelry item to be spring ejected. In order to counteract these effects, a jeweler is required to make adjustments to the holders during soldering operations. Each time a jeweler pauses to make adjustments to the holder, he or she loses valuable time as well as wasting fuel for a torch which is lit. Also, manually adjusting a hot holder can result in bums to a jeweler's hand or hands.

Furthermore, during most jewelry creation or repair jobs, the jewelry piece must be repositioned, sometimes several times, in order to access all sides of the piece. During any soldering operation, it is best to continue until finished since every time a jeweler stops and reflows the solder, alloys within the solder become brittle and porous, developing pitting and oxidation, thus impeding the flow of solder. Furthermore, each time a quantity of solder is re-flowed, a higher temperature is required to melt it. These higher temperatures can adversely affect the precious metal alloys in the jewelry piece itself, often causing it to become weak and brittle, thus limiting its durability. For jewelry holders which are fixed in place, each time the piece must be repositioned, the jeweler must stop what he is doing and either move physically to the other side of the holder, physically move the holder itself, or take the piece out of the holder and turn it around. In addition to the above-enumerated problems of interrupting and restarting work, again, by manually contacting the holder or jewelry piece, the jeweler runs the risk of burning himself.

It is clear, then, that a need exists for an improved jewelry clamp. Such an improved clamp should preferably avoid the problems associated with prior art clamps, i.e. it should not require manual adjustment during work on any given jewelry piece, it should securely clamp the jewelry piece regardless of the temperatures to which it is subjected, it should allow quick and easy placement and removal of the jewelry piece, and it should permit the jeweler to easily access all sides of the clamped jewelry piece.

SUMMARY OF THE INVENTION

The present invention is drawn to a jewelry clamp which securely clamps a piece of jewelry in a position where it is accessible for manufacture or repair. The jewelry clamp includes a circular disc base designed to sit securely on a flat work surface. The base preferably is metallic but can include a non-skid protective surface on the bottom thereof. A rotatable housing, which is preferably made of a solid piece of cast aluminum, has a smooth bell jar shape, and includes a bearing which engages the base such that the housing is freely rotatable about the base. A threaded bore extends vertically through the center of the housing, which threaded bore accommodates an adjustable stop collar and a coil spring. A clamp assembly is then threaded into the threaded bore from the top surface of the rotatable housing. The clamp assembly includes a threaded outer sleeve with stationary clamp jaw and a piston reciprocable within the outer sleeve with a movable clamp jaw. A matching pair of vertically oriented slots are formed opposite each other through the wall of the outer sleeve and a handle extends laterally through the piston and out of each side of the outer sleeve via the slots. The handles, which can be covered with insulated covers, are used to urge the piston downward within the outer sleeve against the spring action, thus separating the movable jaw from the stationary jaw in order to load and remove jewelry pieces from the clamp.

OBJECTS AND ADVANTAGES OF THE INVENTION

The objects and advantages of the present invention include: providing an improved rotatable jewelry clamp; providing such a clamp which includes a base and a housing which is easily and freely rotatable relative to the base; providing such a clamp with a clamp assembly attached to and rotatable with the housing; providing such a clamp in which the clamp assembly includes an outer sleeve threadably engaged with the housing which sleeve includes a stationary clamp jaw and a piston reciprocable within the outer sleeve which piston includes a movable clamp jaw; providing such a clamp with a spring positioned in the housing which engages the piston and urges the movable jaw toward the stationary jaw; providing such a clamp which includes an adjustable stop collar for varying spring tension on the clamp piston; providing such a clamp which is economical, yet durable and relatively maintenance free; and providing such a clamp which is particularly well suited to its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
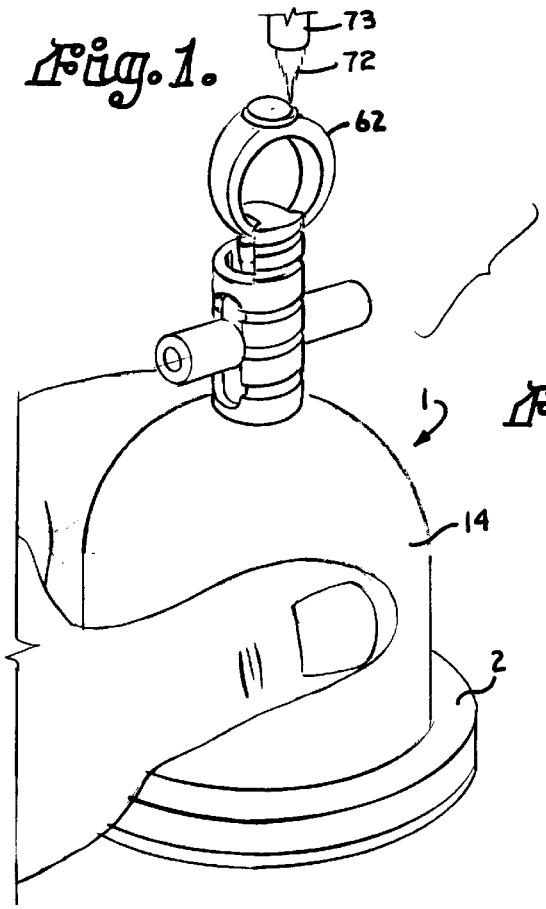
FIG. 1 is a perspective view of a rotating jewelry clamp in accordance with the present invention, shown with a jeweler manipulating the rotatable housing of the clamp to position a ring for application of a torch flame.
Figure 3:
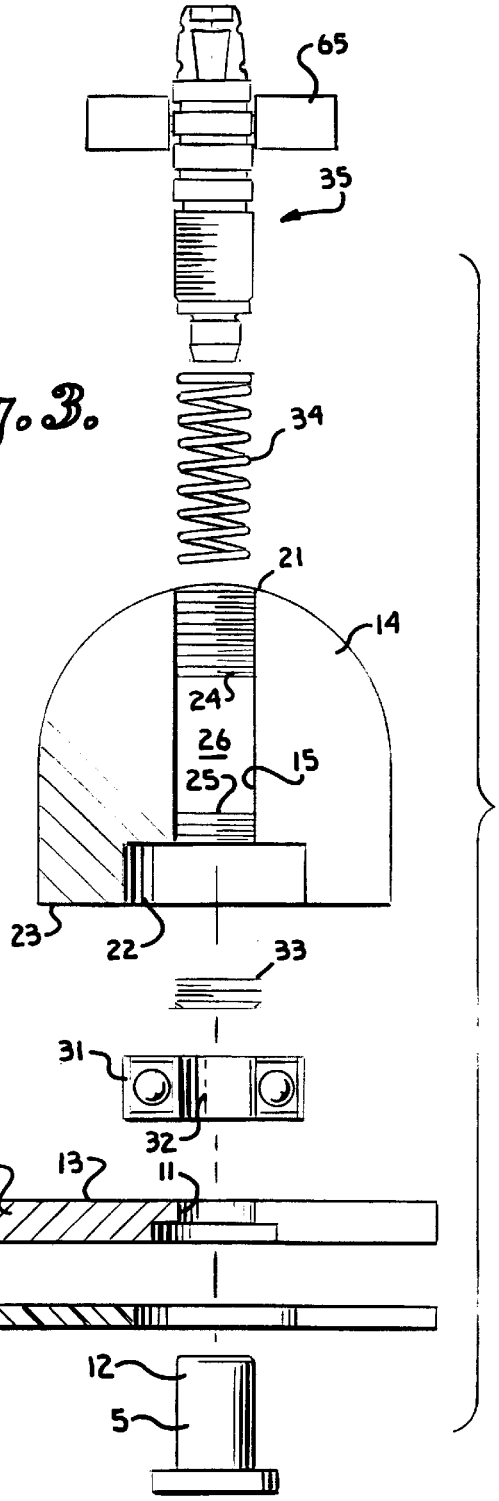
FIG. 3 is an exploded view of the inventive jewelry clamp of FIG. 1, with the housing, base, protective layer and bearing shown in cross-section.
Figure 2:
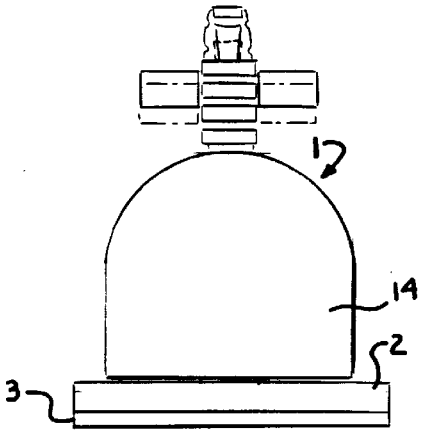
FIG. 2 is a reduced size front elevational view of the jewelry clamp, showing a piston in a clamping position in solid lines and in a release position in dotted lines.
Figure 4:
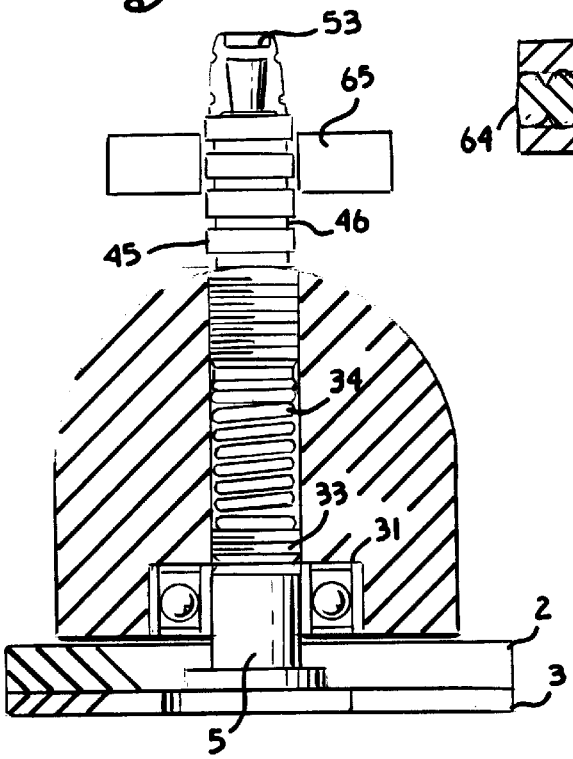
FIG. 4 is an assembled view of the inventive jewelry clamp of FIGS. 1–3, again with the housing, base, protective layer and bearing shown in cross-section and showing a movable jaw and stationary jaw in a cooperative clamping position.

Referring to FIGS. 1–7 of the drawings, a rotating jewelry clamp, generally indicated at 1, is illustrated. The jewelry clamp 1 includes a circular disc base 2 designed to sit securely on a flat work surface. The base preferably is metallic but can include a non-skid protective layer 3 attached to a bottom surface 4 thereof. A upstanding cylindrical peg 5 extends upward through the center of the protective layer 3 and is press fit into the bottom of the base in a centered counter sunk aperture 11. A top portion 12 of the peg 5 protrudes upward from a top surface 13 of the base 2. A rotatable housing 14, which is preferably made of a solid piece of cast aluminum, has a smooth bell jar shape. The housing 14 is preferably of a diameter which allows a user to comfortably grip the exterior of the housing with one hand, as shown in FIG. 1. The rotatable housing 14 is center tapped with a threaded through bore 15 extending through the center of a topmost surface 21 thereof, with the threaded bore 15 extending vertically through the rotatable housing 14 and connecting with a concentric recess 22 formed in the center of a flat bottom surface 23 of the rotatable housing 14. The threaded bore 15 preferably includes upper internal threads 24 extending downward from the top surface 21 and lower internal threads 25 extending upward from the concentric recess 22 with a smooth portion 26 therebetween.

The concentric recess 22 is sized to receive a press fit ball bearing race 31, a center portion 32 of which is sized to snugly receive the cylindrical peg 5. An adjustable, externally threaded stop collar 33 is threaded into the lower internal threads 25 of the threaded bore 15 from the bottom thereof prior to press fitting the bearing 31 into the concentric recess 22. With the stop collar 33 threaded into position from the bottom of the threaded bore 15, a coil spring 34 is inserted into the threaded bore 15 from the top thereof. A clamp assembly 35 is then threaded into the upper threads 24 of the threaded bore 15 from the topmost surface 21 of the rotatable housing 14.

The clamp assembly 35 includes a substantially cylindrical hollow outer sleeve 41 with a lower portion 42 which is equipped with external threads 43 to mate with the upper internal threads 24 in the threaded bore 15 in the rotatable housing 14. A middle portion 44 of the outer sleeve 41 is machined with alternating circumferential rings 45 and recesses 46 which increase the surface area of the outer sleeve 41 to increase heat dissipation. A matching pair of vertically oriented slots 51 are formed opposite each other through the wall of the middle portion 44 of the outer sleeve 41. An upper portion 52 of the outer sleeve 41 forms an L shape with an overhanging stationary jaw 53. The stationary jaw 53 can have a through bore 54 extending therethrough which is sized to receive a pierced earring post (not shown).

Figure 7:
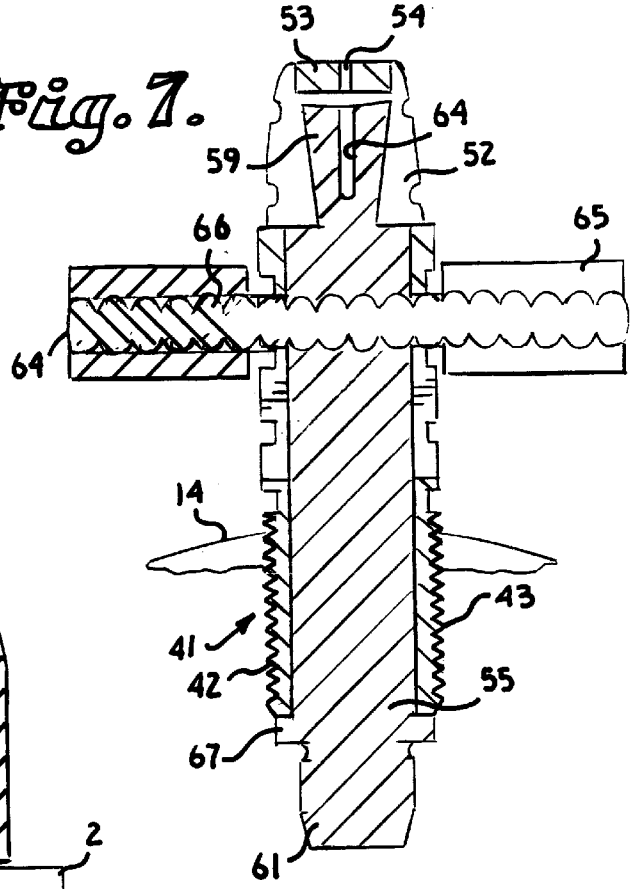
FIG. 7 is an enlarged, cross-sectional view of the clamp assembly, taken along line 7—7 of FIG. 5, and illustrating the piston and movable jaw in a raised, clamping position.
Figure 6:
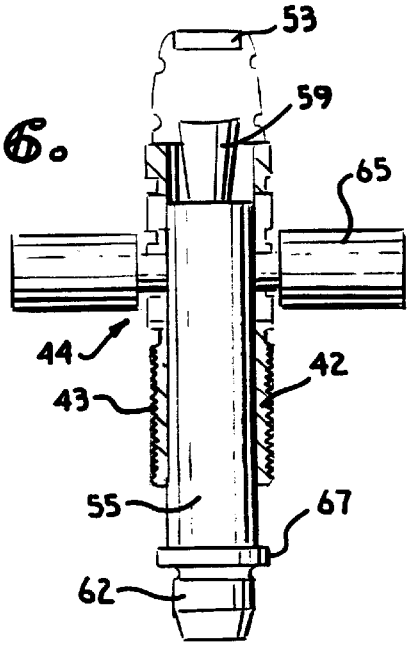
FIG. 6 is an enlarged view of a clamp assembly from the jewelry clamp, with an outer sleeve shoe in cross-section to illustrate the piston and movable jaw in a lowered, release position.
Figure 5:
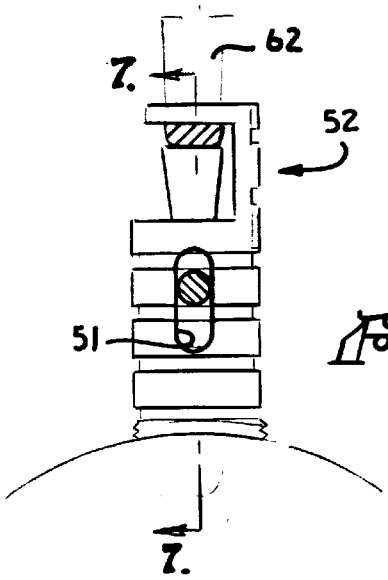
FIG. 5 is a greatly enlarged, fragmentary, side elevational view of the upper portion of the jewelry clamp housing with a clamp assembly threadably inserted therein and illustrating a ring clamped between the movable jaw and stationary jaw.

The clamp assembly 35 also includes a piston 55 which is also preferably cylindrical and which piston 55 is received within and is reciprocal relative to the outer sleeve 41. The piston 55 includes an upper portion which is shaped as a movable jaw 59 which mates with the overhanging stationary jaw 53 in the outer sleeve 41 to collectively form opposing clamping surfaces of the clamp 1. An additional bore 60 can be formed in the movable jaw 59 to align with the through bore 54 in the stationary jaw 53 to receive the pierced earring post, as mentioned earlier. A lower portion 61 of the piston 55 is tapered to engage the coil spring 34 within the rotatable housing 14. When the outer sleeve 41 is threaded into the housing 14, the spring 34 urges the piston 55 upward toward the stationary jaw 53 so that jewelry pieces, such as a ring 62 illustrated in FIG. 1 are securely clamped therebetween. The ring 62 is thus clamped into position between the movable jaw 59 and the stationary jaw 53 via tension caused by the compressed spring 34. An upper surface of the movable jaw 59 can be concave shaped, as is most clearly indicated in FIG. 6, to better grip the circumference of the ring 62. The piston 55 also includes a through bore 63 extending laterally through it which receives a handle 64. The handle 64 extends laterally out from opposing sides of the piston 55 and through the matching slots 51 on either side of the outer sleeve 41 such that, by pressing down on the handle 64, the piston 55 is urged downward against the spring 34, thus separating the movable jaw 59 and the stationary jaw 53 and allowing a jewelry piece, such as the ring 62, to be inserted or removed from between the movable jaw 59 and the stationary jaw 53. Cylindrical protective insulated coverings 65, which may be formed of high temperature resistant rubber or plastic, can be slipped over either end of the handle 64 to prevent a jeweler from burning his or her hands while releasing the clamp 1. The handle 64 can be shaped with ribs 66, as shown in FIG. 7, to increase surface area and heat dissipation qualities.

The piston 55 has a smaller outside diameter than the inside diameter of the outer sleeve 41, which allows it to freely reciprocate up and down within the outer sleeve 41. The piston 55 also has a perimeter ring 67 formed thereon which ring 67 has an outside diameter greater than the inside diameter of the outer sleeve 41. The ring 67 thus functions as a limiting stop to for the piston 55 to prevent the movable jaw 59 from hitting the stationary jaw 53.

FIG. 1 illustrates the clamp being used to hold the ring 62 while soldering of a jewel 71 as a flame 72 is directed to a perimeter portion of the jewel 72 via a torch 73.

In addition to the illustrated jewelry clamp 1, a number of variations will occur to those of skill in the art. For example, the bell shape of the housing 14 is but one example of a number of possible shapes, including cylinders, cubes, triangular wedges, etc. which could be used for the housing 14. Similarly the base 2 could be any desired shape, either matching or contrasting with the housing shape. Similarly, a wide variety of shapes for the movable jaw 61 and overhanging stationary jaws 53 is possible as well, depending upon the particular jewelry styles being worked on. While the bearing 31 has been illustrated as mounted within the housing 14 and the peg 5 as mounted within the base 2, they could be reversed in position as well. Thus, it is to be understood that while certain forms of the present invention have been illustrated and described herein, it is not to be limited to the specific forms or arrangement of parts described and shown.

What is claimed and desired to be secured by Letters Patent is as follows:

1. A jewelry clamp, comprising:

a) a base;

b) a housing rotatable relative to said base; and c) a clamp assembly attached to and being rotatable with said housing, said clamp assembly including:

i) an outer sleeve;

ii) a piston partially positioned within and being reciprocal relative to said outer sleeve;

iii) a first clamping surface attached to said piston, said first clamping surface being formed by a movable law extending upward from said piston; and iv) a second clamping surface attached to said outer sleeve, said second clamping surface being formed by an overhanging stationary law attached to and extending inward from a perimeter of said outer sleeve.

2. A jewelry clamp as in claim 1, and further comprising:

a) a peg extending upward from said base; and b) a bearing positioned in said housing, said bearing including a center aperture which is sized to receive said peg such that said housing is supported by and is rotatable about said peg.

3. A jewelry clamp as in claim 1, wherein:

a) said first clamping surface has a through bore extending therethrough which is sized to accommodate a post of an earring; and b) said second clamping surface has a bore aligned with said through bore.

4. A jewelry clamp as in claim 1, wherein said outer sleeve includes external threads which mate with internal threads in a threaded bore extending downward into said housing and said jewelry clamp further comprises:

a) a spring positioned within said threaded bore in said housing, said spring engaging a bottom portion of said piston as said outer sleeve is threaded into said threaded bore such that said spring urges said piston upward within said outer sleeve to move said first clamping surface toward said second clamping surface.

5. A jewelry clamp as in claim 4, wherein said outer sleeve includes at least one slot extending through a wall thereof, said jewelry clamp further comprising:

a) a handle attached to and extending outward from said piston, said handle extending through said slot and being accessible to a user such that, by grasping said handle and pushing it downward, said piston is moved against the action of said spring, thus separating said first clamping surface from said second clamping surface.

6. A jewelry clamp as in claim 4, wherein said threaded bore is a through bore extending from top to bottom of said housing, said clamp further comprising:

a) a stop collar with exterior threads which mate with threads in said through bore, said stop collar being threadably adjustable within said through bore to adjust the spring tension on said piston.

7. A jewelry clamp as in claim 1, wherein said housing has a bell shape.

8. A jewelry clamp, comprising:

a) a base;

b) a housing rotatable relative to said base, said housing including a threaded bore extending downward from an upper surface thereof;

c) a clamp assembly attached to and being rotatable with said housing, said clamp assembly including:

i) an outer sleeve, said outer sleeve including external threads which mate with threads in said housing threaded bore;

ii) a piston partially positioned within and being reciprocable relative to said outer sleeve;

iii) a first clamping surface attached to said piston; and iv) a second clamping surface attached to said outer sleeve; and d) a spring positioned within said threaded bore in said housing, said spring engaging a bottom portion of said piston as said outer sleeve is threaded into said threaded bore such that said spring urges said piston upward within said outer sleeve to move said first clamping surface toward said second clamping surface.

9. A jewelry clamp as in claim 8, wherein said outer sleeve includes at least one slot extending through a wall thereof, said jewelry clamp further comprising:

a) a handle attached to and extending outward from said piston, said handle extending through said slot and being accessible to a user such that, by grasping said handle and pushing it downward, said piston is moved against the action of said spring, thus separating said first clamping surface from said second clamping surface.

10. A jewelry clamp as in claim 8, wherein said threaded bore is a through bore extending from top to bottom of said housing, said clamp further comprising:

a) a stop collar with exterior threads which mate with threads in said through bore, said stop collar being threadably adjustable within said through bore to adjust the spring tension on said piston.

11. A jewelry clamp, comprising:

a) a base;

b) a housing rotatable relative to said base;

c) a clamp assembly attached to and being rotatable with said housing, said clamp assembly including first and second opposed clamping surfaces, said first clamping surface being movable toward and away from said second clamping surface;

d) a peg extending upward from said base; and e) a bearing positioned in said housing, said bearing including a center aperture which is sized to receive said peg such that said housing is supported by and is rotatable about said peg.

12. A jewelry clamp as in claim 11, said clamp assembly comprising:

a) an outer sleeve;

b) a piston partially positioned within and being reciprocable relative to said outer sleeve; and wherein c) said first clamping surface is attached to said piston and said second clamping surface is attached to said outer sleeve.

13. A jewelry clamp as in claim 11, wherein:

a) said first clamping surface is formed by a movable jaw extending upward from said piston; and b) said second clamping surface is formed by an overhanging stationary jaw attached to and extending inward from a perimeter of said outer sleeve.

14. A jewelry clamp as in claim 11, wherein said housing has a bell shape.

15. A jewelry clamp, comprising:

a) a base;

b) a housing rotatable relative to said base;

c) a clamp assembly attached to and being rotatable with said housing, said clamp assembly including first and second opposed clamping surfaces, said first clamping surface being movable toward and away from said second clamping surface, said clamp assembly comprising:

i) an outer sleeve;

ii) a piston partially positioned within and being reciprocal relative to said outer sleeve; and wherein iii) said first clamping surface is attached to said piston and said second clamping surface is attached to said outer sleeve, said first clamping surface being formed by a movable jaw extending upward from said piston; and said second clamping surface being formed by an overhanging stationary jaw attached to and extending inward from a perimeter of said outer sleeve.

16. A jewelry clamp as in claim 15, and further comprising:

a) a peg extending upward from said base; and wherein b) said bearing is positioned in said housing, said bearing including a center aperture which is sized to receive said peg such that said housing is supported by and is rotatable about said peg.

17. A jewelry clamp as in claim 15, wherein:

a) said first clamping surface has a through bore extending therethrough which is sized to accommodate a post of an earring; and b) said second clamping surface has a bore aligned with said through bore.

18. A jewelry clamp as in claim 15, wherein said outer sleeve includes external threads which mate with internal threads in a threaded bore extending downward into said housing and said jewelry clamp further comprises:

a) a spring positioned within said threaded bore in said housing, said spring engaging a bottom portion of said piston as said outer sleeve is threaded into said threaded bore such that said spring urges said piston upward within said outer sleeve to move said first clamping surface toward said second clamping surface.

19. A jewelry clamp as in claim 18, wherein said outer sleeve includes at least one slot extending through a wall thereof, said jewelry clamp further comprising:

a) a handle attached to and extending outward from said piston, said handle extending through said slot and being accessible to a user such that, by grasping said handle and pushing it downward, said piston is moved against the action of said spring, thus separating said first clamping surface from said second clamping surface.

20. A jewelry clamp as in claim 18, wherein said threaded bore is a through bore extending from top to bottom of said housing, said clamp further comprising:

a) a stop collar with exterior threads which mate with threads in said through bore, said stop collar being threadably adjustable within said through bore to adjust the spring tension on said piston.

* * * * *